United States Patent [19]

Cook

[11] Patent Number: 4,485,947

[45] Date of Patent: Dec. 4, 1984

[54] HANDGUN HOLSTER WITH CONTRACTIVE SHAPE MEMORY

[75] Inventor: Clifton L. Cook, Boise, Id.

[73] Assignee: Michaels of Oregon Co., Portland, Oreg.

[21] Appl. No.: 425,423

[22] Filed: Sep. 28, 1982

[51] Int. Cl.[3] ..... F41C 33/02

[52] U.S. Cl. ..... 224/243; 224/911; 150/52 G

[58] Field of Search ..... 224/243, 192, 193, 206, 224/244, 911, 908, 913; 206/316, 521, 523; 150/52 R, 52 C, 52 H, 52 J, 2.1, 2.2, 52 G

[56] References Cited

U.S. PATENT DOCUMENTS

| | | | |
|---|---|---|---|
| 1,547,800 | 7/1925 | Franz | 224/911 X |
| 3,303,865 | 2/1967 | Ouimet | 150/52 G |
| 3,948,436 | 4/1976 | Bambara | 206/523 X |
| 4,162,696 | 7/1979 | Sprung | 150/52 J |
| 4,197,890 | 4/1980 | Simko | 150/2.2 |
| 4,257,464 | 3/1981 | Binney | 224/911 X |

*Primary Examiner*—Steven M. Pollard
*Attorney, Agent, or Firm*—Chernoff, Vilhauer, McClung, Birdwell & Stenzel

[57] ABSTRACT

A universal-type protective holster capable of receiving snugly hand guns of different sizes falling within a defined range of sizes. The holster is formed with a sandwich-like construction, including an inner liner web in the form of a soft-surfaced fabric for protecting a received handgun against marring, an intermediate memory web in the form of an elastomer which provides the holster with contracted-shape memory enabling it to receive handguns of different sizes easily, and an outer shell web in the form of a relatively stiff, tear-and-abrasion-resistant fabric.

8 Claims, 4 Drawing Figures

HANDGUN HOLSTER WITH CONTRACTIVE SHAPE MEMORY

BACKGROUND AND SUMMARY OF THE INVENTION

This invention pertains to a holster for a handgun, such as a revolver, and more particlarly to a holster which is referred to herein as a universal-type holster designed to be capable of accommodating and protecting handguns of different sizes falling within a defined range of sizes.

It is common for handgun enthusiasts to own a plurality of handguns, such as a plurality of revolvers, each of which, from time to time, they take out for sport-shooting purposes. Normally, such a gun is taken out in a protective holder known as a holster which is attached, in various suitable manners, to clothing along the side of the user's hip.

In the past, holsters for such a purpose have been designed to accommodate particular handguns, or at least particular sizes of handguns, and have not proven particularly adequate to handle adequately, and with full protection, a range of hand gun sizes. For example, perhaps the most common type of holster available is one made of a relatively stiff and hard leather. Such a holder is often designed to hold a particular size and type of handgun, and after extended use with a particular handgun tends to take on, in a memorized sense, the shape of the handgun. This kind of holster, for the reason just given, is ordinarily not capable, particularly after it takes on a memorized shape, of handling handguns of different sizes.

Another kind of conventional holster is formed of various relatively soft materials. Such holsters, while not necessarily taking on the shapes of accommodated handguns, nevertheless function best when used with a particular handgun, or a particular size of a handgun.

As a further consideration, while leather-type holsters provide a snug fit for a particular handgun, and very adequate protection from "outside" injury, they have a tendency, well-known, to wear off the bluing found on the surfaces of most guns as a consequence of repeated insertion and withdrawal of a handgun relative to the holster. Conventional soft holsters usually avoid this problem, but fail to provide adequate protection against events in the "outside" world.

A general object of the present invention, therefore, is to provide a holster which is referred to herein as a universal-type holster, having a contracted or relaxed-state memory which enables it, from time to time, to receive and hold snugly handguns of different sizes falling within a defined range of sizes.

Another object of the invention is to provide such a holster which also minimizes wear on the blued surface in a gun when the same is used with the holster, and which further maximizes protection against damage from the outside world.

According to a preferred embodiment of the invention, a holster is proposed which is characterized by a sandwich-type construction including three layers. An inner layer in the holster takes the form of a soft fabric, which acts as a lining that directly contacts a received handgun and minimizes the surface wear problem. An intermediate or central lining in the holster takes the form of a yieldably firm elastomer, such as a closed-cell foam, which functions to provide contracted-shape memory—allowing the holster to deform to accommodate, from time to time, all handguns fitting within the defined range of sizes for the holster. An outer layer takes the form of a durable, wear and abrasion resistant fabric, such as a heavy-duty nylon material, to provide "outside world" protection.

These three layers are surface-bonded to one another using any one of a variety of conventional suitable adhesives.

The proposed holster offers all of the advantages discussed generally above, and substantially avoids all of the drawbacks. Each of the three layers in the holster functions to provide a particular use advantage, and the collection of layers acts to furnish an extremely reliable and versatile holster. Relaxed-shaped memory is provided by the central layer, and this feature enables the holster, within the defined range of sizes of handguns related to the holster, to accommodate snugly all hand guns fitting within that range. In other words, the holster does not take on a specific memory unique to one-only of such guns. The inner layer obviates the problem of surface wear on the finish of a handgun as the same is carried in, and inserted and retracted with respect to, the pocket formed in the holster. The outer layer offers a tough outer shell to protect a gun against outside damage.

These and other objects and advantages which are attained by the invention will become more fully apparent as the description which now follows is read in conjunction with the accompanying drawings.

DETAILED DESCRIPTION OF THE INVENTION

Figures 1, 2, 3, 4:
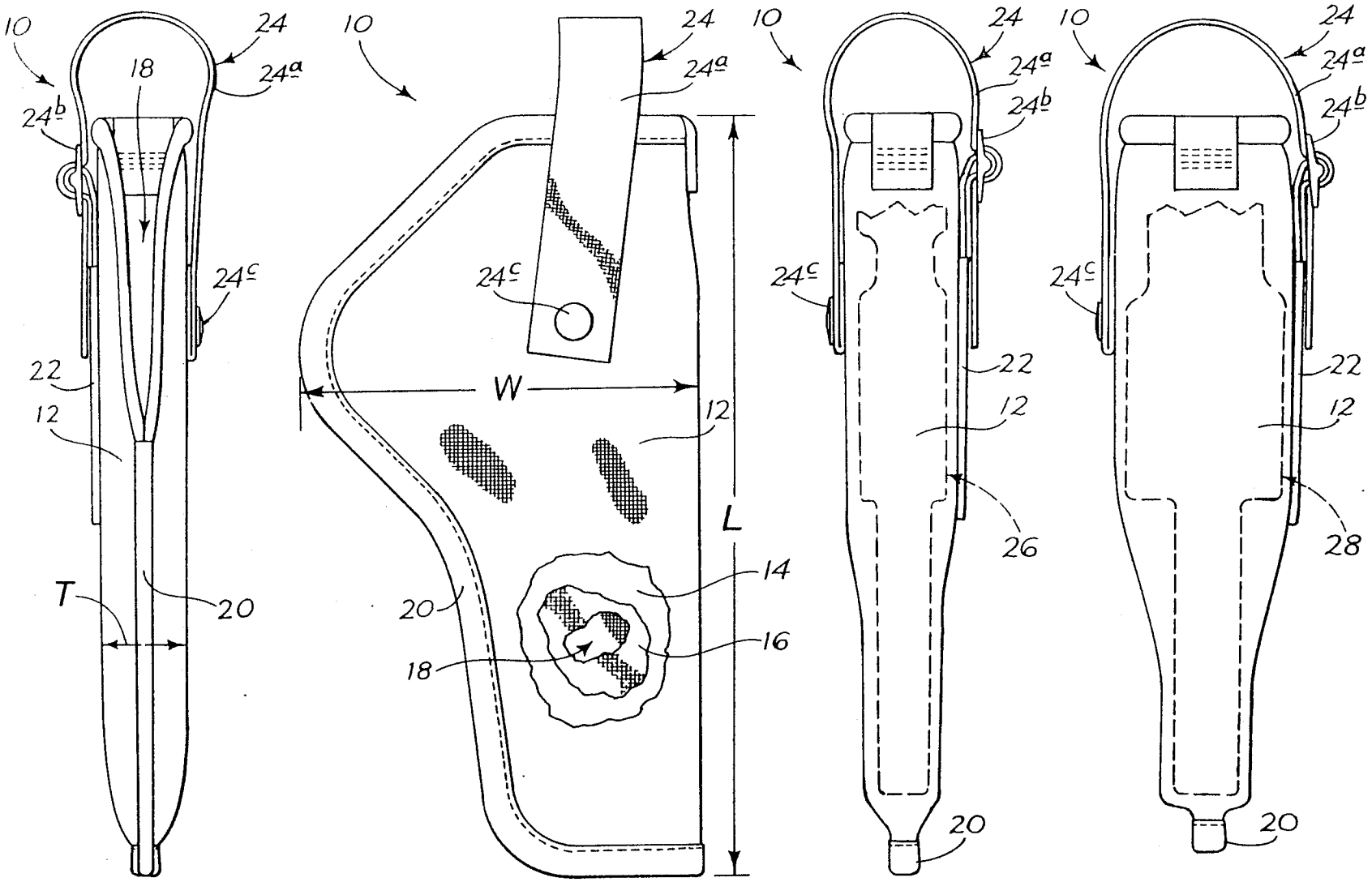
FIG. 1 is a side elevation showing the outer side of a holster constructed in accordance with the present invention. Portions have been broken away to illustrate details of construction.
FIG. 2 is a view taken generally from the left side of FIG. 1.
FIGS. 3 and 4 are views taken from the right side of FIG. 1, showing the holster in use with two different size revolvers.

Turning now to the drawings, and referring first of all to FIGS. 1 and 2, indicated generally at 10 is a universal-type holster which is constructed in accordance with the present invention. The particular holster shown herein is what might be thought of as a right-hand holster. FIG. 1 shows the outer side of the holster as such would appear when worn by a right-handed user, and FIG. 2 shows what might be thought of as the rear side of the holster.

According to key features of the invention, holster 10 is formed with what is referred to herein as a sandwich-type construction, having an outer layer, or web, 12, an intermediate layer, or web, 14, and an inner layer, or web, 16. Each of these web has substantially the same peripheral outline when layed out or developed, with the three layers, after assembly thereof, then folded and joined with a seam, as will be described, to define a hand gun-receiving pocket 18. As can be seen clearly in FIG. 2, the upper side of pocket 18 is open in the manner usually expected in a handgun holster.

Outer web 12 is also referred to herein as a shell web, and preferably is formed of a relatively stiff, tear-and-abrasion-resistant fabric, such as a heavy-duty nylon fabric. In holster 10, web 12 is formed of a nylon material sold by Howe & Bainbridge of Boston, Massachusetts—identified as 12-ounce style N51MLK nylon. This kind of material has been proven to form an extremely effective tough outer shell surface for holster 10.

Intermediate web 14 constitutes a memory web herein, and preferably is formed from a yieldably firm elastomer having excellent retentive memory characteristics. In holster 10, web 14 is formed of a closed-cell polyethylene foam made by the Uniroyal Company and identified by catalog No. PE-205. Web 14, which is the thickest (in cross section) of the three webs making up holster 10, has a web thickness of about ¼-inches.

Inner web 16 is referred to herein also as a liner web, and is preferably formed of a soft-surfaced fabric, such as a light weight nylon fabric. In holster 10, web 16 is formed of a 4-ounce nylon material made by Howe & Bainbridge identified as type N40DR nylon.

The respective confronting faces in the interfaces between webs 12, 14, 16 are bonded by any suitable flexible adhesive.

The three bonded webs are folded to give the holster the side configuration clearly seen in FIG. 1, with the exposed edges of the webs bound by a stitched-on bead of any suitable material, such as the nylon ribbon shown at 20 in the figures. In holster 10, ribbon 20 is formed using what is known as style 259N nylon ribbon made by American Cord & Webbing in Lincoln, Rhode Island. Stitching on of this ribbon in holster 10 is done in a conventional fashion utilizing heavy-duty nylon thread.

In FIGS. 1 and 2, holster 10 is shown in what might be thought of as a relaxed-state condition, with no revolver contained in pocket 18. In this condition, the particular holster illustrated has a length L of about 9.5-inches, a width W (shown in FIG. 1 only) of about 4.5-inches, and a thickness T (shown in FIG. 2 only) of about 0.75-inches. While, as will be apparent to those skilled in the art, a holster like holster 10 may be constructed in accordance with the invention to have different specific sizes in order to suit different use conditions, holster 10 herein has been designed to accommodate revolvers having sizes within the range defined by a minimum revolver size as is characterized by revolvers having what is known in the trade as a medium frame, and a maximum revolver size as is characterized by revolvers having a large frame. Completing a description of holster 10, and still referring to FIGS. 1 and 2, the holster further includes on its inner side what will be referred to herein as a belt loop patch 22, and a safety strap assembly 24. Patch 22 is formed using what is known as No. 339 nylon made by American Cord & Webbing, with the patch forming the usual belt loop enabling securing of the holster in a well-known manner on a user's belt.

Assembly 24 includes an adjustable-length strap **24*a*, whose effective length is adjusted through manipulation of a slider lock 24*b*. What might be thought of as the inner extremity of strap 24*a* is suitably secured to the inner side of the holster adjacent patch 22, and the outer extremity of the strap is furnished with releasable locking snaps, such as snap 24*c*, which attaches and releases in a well-known manner with respect to snap buttons (concealed) provided on the outer side of the holster. With a handgun received in pocket 18, securing of the outer end of strap 24*a*** with the same extending over the rear of the gun acts as a safety to prevent inadvertent withdrawal of the gun from the holster.

FIGS. 3 and 4 show holster 10 in two different use conditions which represent what might be thought of herein as "limit" use conditions.

In FIG. 3, holster 10 is shown holding the smallest revolver, illustrated fragmentarily at 26, for which it is designed. Revolver 26 herein is a Smith & Wesson Model 19, 6" barrel revolver.

In FIG. 4, the holster is shown holding the largest revolver (depicted fragmentarily at 28) for which it is designed. Revolver 28 herein is a Smith & Wesson model 27, 6" barrel revolver.

As can be seen clearly in FIGS. 3 and 4, in both use conditions depicted, the holster snugly and firmly receives revolvers 26 and 28. The same also is true with respect to revolvers having sizes falling within the range of sizes defined by revolvers 26, 28. Because of the unique way in which web 14 cooperates herein with webs 12, 16, it makes no difference for how long a time a revolver (within the proper design range for the holster) is held therein, with respect to the holster's ability, with the gun removed, thereafter to return through memory action to the same configuration depicted in FIGS. 1 and 2.

Inner web 16 cooperates in the holster to provide a soft lining for pocket 18 which obviates marring and wearing of a blued finish on a gun. Outer web 12 cooperates in the holster assembly to provide a tough protective outer shell for the holster.

As can be appreciated now from the description which has just been given, and from the illustrations in the drawings, the holster proposed by the present invention offers all of the advantages ascribed to it eariler, and avoids all of the major deficiencies that characterize prior art conventional holsters.

While a preferred embodiment of the invention has been described herein, it is appreciated that variations and modifications may be made without departing from the spirit of the invention.

It is claimed and desired to be secured by U.S. Letters Patent:

1. A universal-type, sandwich-construction, mar-inhibiting, protective holster for accommodating, snugly under all use circumstances, and at different selected times, different handguns having different sizes which reside within a defined range of sizes, said holster comprising:

a relaxed-shaped memory web taking the form generally of a yieldably firm elastomer defining a central, folded, contracted-shape memory-retentive layer in the holster, a liner web, taking the form generally of a soft-surfaced fabric joined to, and substantially coextensive with the inside face of, said memory web, and defining a pliable, folded, non-abrasive, inside handgun-contacting layer in the holster, and a shell web taking the form generally of a relatively stiff, tear-and-abrasion-resistant fabric, joined to, and substantially coextensive with the outside face of, said memory web, and defining a pliable, folded, wear-resistant, outer protective surface in the holster, said three webs having their respective confronting faces bonded by adhesive, said three webs collectively forming a handgun-receiving pocket bounded directly by said liner web, and reversibly deformable to receive, and to grasp snugly, by virtue of deformation in said memory web, any handgun characterized by such defined range of sizes, with prior snug receipt and grasping of a handgun having one size within such range of any time interval, being ineffective to prevent any later, like, snug grasping and receipt of a handgun having, within such range, a size which is smaller than such one size.

2. A protective holster for accommodating, snugly under all use circumstances, and at different selected times, different handguns having different sizes which reside within a defined range of sizes, said holster comprising:

(a) an inner layer of soft-surfaced pliable fabric defining a non-abrasive, handgun-contacting inner surface in the holster;

(b) an intermediate layer, substantially coexstensive in size and shape with said inner layer and joined thereto, of an elastically yieldingly compressible and shape-restoring material having a thickness greater than that of said inner layer; and (c) an outer layer of a relatively stiff, tear-resistant and abrasion-resistant fabric substantially coextensive in shape and size with said intermediate layer and joined thereto, defining a wear-resistant protective outer surface of said holster, said three layers collectively defining a handgun-receiving pocket bounded directly by said inner layer and having a relaxed shape, said handgun-receiving pocket being elastically self-restoring to said relaxed shape to receive, and to grasp snugly, any handgun characterized by such defined range of sizes, by exerting pressure resulting from elastic deformation of at least said intermediate layer against the surfaces of said handgun, with prior snug receipt and grasping of a handgun having one size within such range being ineffective to prevent any later snug receipt and grasping of any other handgun having a size which is within such range.

3. The holster of claim 2 wherein said intermediate layer is of a closed-cell foam plastics material.

4. A holster for protectively holding, at different selected times, a handgun of any of a plurality of different sizes within a respective defined range of sizes, said holster comprising:

(a) a protective outer layer of stiff, scratch-resistant, abrasion-resistant fabric;

(b) a pliant, soft-surfaced inner layer of relatively thin material substantially coextensive with said protective outer layer;

(c) an intermediate layer of relatively thick elastically compressible and yielding material substantially coextensive with said inner and outer layers;

(d) said three layers being in substantially overlying registration with one another and connected with one another at least along respective marginal portions thereof as a sandwich combination, said sandwich combination of three layers being folded and respective opposite marginal portions thereof being in overlying proximity with one another and being connected with one another, forming a handgun-receiving pocket having said inner layer as the interior surface thereof, said intermediate layer within said pocket being elastically compressible and self-restoring to receive and to grasp snugly any handgun characterized by such defined range of sizes, with prior snug receipt and grasping of a handgun having one size within such defined range being ineffective to prevent any later snug receipt and grasping of any handgun having a size which is within such defined range of sizes.

5. The holster of claim 4 wherein said intermediate layer is of a closed-cell foam plastics material.

6. The holster of claim 4 wherein adjacent surfaces of said layers are bonded together over substantially their entire extent.

7. The holster of claim 4 wherein said handgun-receiving pocket surrounds at least a portion of a handgun located therein so as to elastically and compressively grip said handgun, with said intermediate layer and said protective outer layer being elastically deformed.

8. The holster of claim 4 wherein said intermediate layer has a relaxed shape when said holster is empty, said intermediate layer being effective to restore itself elastically to said relaxed shape upon removal from said holster of a handgun characterized by such defined range of sizes.

* * * * *